US011015452B2

(12) United States Patent
Park

(10) Patent No.: US 11,015,452 B2
(45) Date of Patent: May 25, 2021

(54) GAS TURBINE BLADE

(71) Applicant: Doosan Heavy Industries & Construction Co., Ltd., Gyeongsangnam-do (KR)

(72) Inventor: Jong Hoon Park, Gyeongsangnam-do (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 672 days.

(21) Appl. No.: 15/235,568

(22) Filed: Aug. 12, 2016

(65) Prior Publication Data

US 2017/0044905 A1 Feb. 16, 2017

(30) Foreign Application Priority Data

Aug. 13, 2015 (KR) ..... 10-2015-0114631

(51) Int. Cl.
*F01D 5/18* (2006.01)
*F01D 5/28* (2006.01)

(52) U.S. Cl.
CPC ..... *F01D 5/186* (2013.01); *F01D 5/288* (2013.01); *F05D 2220/32* (2013.01); *F05D 2230/90* (2013.01); *F05D 2240/30* (2013.01); *F05D 2240/81* (2013.01); *F05D 2250/12* (2013.01); *F05D 2250/22* (2013.01); *F05D 2260/202* (2013.01)

(58) Field of Classification Search
None
See application file for complete search history.

(56) References Cited

U.S. PATENT DOCUMENTS 6,234,755 B1 * 5/2001 Bunker ..... F01D 5/186 416/97 R
8,105,030 B2 * 1/2012 Abdel-Messeh ..... F01D 5/187 416/95
8,608,443 B2 * 12/2013 Lee ..... F01D 5/186 415/115

(Continued)

FOREIGN PATENT DOCUMENTS

EP 2-615-245 A2 7/2013
EP 2-619-443 A2 7/2013

(Continued)

OTHER PUBLICATIONS

European Search Report dated Jan. 24, 2017 in European Application No. 16184085.5.

(Continued)

*Primary Examiner* — Juan G Flores
(74) *Attorney, Agent, or Firm* — Invenstone Patent, LLC

(57) ABSTRACT

A gas turbine blade has a trench part of a film cooling unit for cooling a blade part that is formed at a tip of a film cooling hole part. As a result, cooling efficiency of the blade can be improved since the blade part is sufficiently cooled even during introduction of a large amount of cooling air, durability of the blade can be increased by inhibiting the blade from being damaged due to hot gas since the trench part is formed to have a minimum width, and efficiency of a gas turbine can be increased by an improvement in film efficiency.

17 Claims, 5 Drawing Sheets

(56) References Cited

U.S. PATENT DOCUMENTS

| | | | | |
|---|---|---|---|---|
| 8,870,536 | B2 * | 10/2014 | Lacy | F01D 5/186 416/97 R |
| 9,028,207 | B2 * | 5/2015 | Zuniga | F01D 5/186 415/178 |
| 2010/0040478 | A1 * | 2/2010 | Abdel-Messeh | F01D 5/187 416/97 R |
| 2011/0305583 | A1 * | 12/2011 | Lee | F01D 25/12 416/97 R |
| 2012/0076644 | A1 * | 3/2012 | Zuniga | F01D 5/186 415/178 |
| 2013/0183166 | A1 * | 7/2013 | Lacy | F01D 5/186 416/97 R |
| 2015/0107798 | A1 * | 4/2015 | Pfitzner | F01D 5/186 165/56 |

FOREIGN PATENT DOCUMENTS

| | | | |
|---|---|---|---|
| EP | 2-889-451 | A1 | 7/2015 |
| JP | 2012-082700 | A | 4/2012 |
| KR | 10-1434926 | B1 | 8/2014 |
| WO | WO-2011/156805 | A1 | 12/2011 |

OTHER PUBLICATIONS

Office Action dated Aug. 31, 2017 in Korean Application No. 10-2015-0114631.

* cited by examiner

GAS TURBINE BLADE

CROSS-REFERENCES TO RELATED APPLICATION

This application claims the benefit under 35 U.S.C. § 119 of Korean Patent Application No. 10-2015-0114631, filed Aug. 13, 2015, which is hereby incorporated by reference in its entirety.

BACKGROUND

Field of the Invention

Exemplary embodiments of the present invention relate to a gas turbine blade and, more particularly, to a gas turbine blade capable of improving cooling efficiency of a blade part and having improved durability by forming a trench part of a film cooling unit for cooling the blade part at a tip of a film cooling hole part.

Description of the Related Art

In general, gas turbines are mainly used as one of power sources for rotating generators in power plants, etc.

Such a gas turbine includes a compressor, a combustor, and a turbine.

The gas turbine includes the compressor which is connected thereto by a shaft to be driven by the turbine.

Air introduced from an air inlet is compressed in the compressor.

The air compressed by the compressor flows into a combustion system, and the combustion system includes one or more combustors and a fuel nozzle for injecting fuel into each of the combustors.

The fuel introduced through the fuel nozzle and the compressed air are combusted together in the combustor, and thus high-temperature compressed gas is generated.

The high-temperature compressed gas generated by the combustor flows into the turbine.

In general, a plurality of gas turbine blades is coupled to the gas turbine in order to rotate the turbine using pressure when high-temperature and high-pressure gas is discharged.

The blades of the turbine rotate while the high-temperature and high-pressure gas introduced into the turbine is expanded, and thus a rotor connected to the blades rotates so as to generate electric power. The gas expanded in the turbine is discharged to the outside or is discharged to the outside via a cogeneration plant.

The plurality of combustors constituting the combustion system of the gas turbine is typically arranged in a casing in the form of cells.

The gas turbine rotates the turbine using high-temperature and high-pressure gas generated when compressed air and fuel are combusted in a combustion chamber, so as to generate torque required to drive the generator.

In general, various cooling methods such as film cooling have been developed in order to cool gas turbine blades driven by high-temperature combustion gas.

In the conventional gas turbine blade, the film cooling method protects the blade from hot gas by forming holes on the surface of the blade and forming an air film on the surface of the blade using cooling air introduced into the blade.

In addition, the durability and safety of the conventional gas turbine blade may be deteriorated since the blade is damaged due to a reduction in cooling effect.

Furthermore, costs and times may be increased due to replacement of the damaged blade in the conventional gas turbine blade.

Moreover, gas turbine efficiency may be decreased due to deterioration of the blade cooling efficiency in the conventional gas turbine blade.

BRIEF SUMMARY

Provided herein is a gas turbine blade in which a trench part of a film cooling unit for cooling a blade part is formed at a tip of a film cooling hole part. As a result, cooling efficiency of the blade can be improved since the blade part is sufficiently cooled even during introduction of a large amount of cooling air, durability of the blade can be increased by inhibiting the blade from being damaged due to hot gas since the trench part is formed to have a minimum width, and efficiency of a gas turbine can be increased by an improvement in film efficiency.

Other advantages of the present invention can be understood from the following description and become apparent with reference to the embodiments of the present invention. Also, those skilled in the art to which the present invention pertains will clearly understand that the advantages of the present invention can be realized by the means as claimed and combinations thereof.

In an embodiment, a gas turbine blade includes a blade part, a root part formed at a radial inner end of the blade part while being coupled to a rotor, and a film cooling unit formed on the blade part that cools the blade part, wherein the film cooling unit includes a film cooling hole part formed on a surface of the blade part that cools the surface of the blade part, and a trench part formed at a tip of the film cooling hole part.

The film cooling hole part may include a cooling groove portion into which cooling air for cooling the surface of the blade part is introduced, a flow portion communicating with the cooling groove portion such that the cooling air flows to the surface of the blade part, and a tube expansion portion having a cross-sectional area that is increased toward the surface of the blade part from a tip of the flow portion.

The trench part may have a height equal to a thickness of a coating layer formed on the blade part.

The trench part may have a width and height that are the same as each other.

The tube expansion portion may extend so as to be inclined downward toward the trench part from an extended end of the flow portion.

The tube expansion portion may have an opened surface formed in a polygonal shape.

The trench part may have a width that is narrowed toward both ends of the trench part from a center portion of the trench part adjacent to a tube expansion portion.

A ratio of a height to a width of the trench part may be 1:1 to 2.

The trench part may have a smaller width than a width of a tube expansion portion.

The film cooling unit may include a plurality of film cooling units, and a distance between the film cooling units arranged around a leading edge may be relatively shorter than a distance between the film cooling units arranged around a trailing edge.

The film cooling hole part may be opened toward a center portion of the trench part.

When cooling air is supplied to a region of the trench part, the cooling air may be ejected toward a center of the trench part through the film cooling hole part, and then branched into both left and right sides to move, so as to perform cooling.

The blade part may include a leading edge facing an introduction side of fluid, a trailing edge facing a discharge side of fluid, and first and second surfaces connecting the leading edge to the trailing edge, and the film cooling unit may be formed on the first surface.

The film cooling unit may include a plurality of film cooling units formed on the first surface so as to be spaced by a predetermined distance in a radial direction of the blade part.

The film cooling unit may include a plurality of film cooling units alternately arranged on the first surface.

The film cooling hole part formed in the film cooling unit may be formed by coating a film.

The trench part may be formed by masking.

A center portion of the trench part may be formed by fillet processing.

The root part may include a platform part formed at the radial inner end of the blade part, and a dovetail part formed at a radial inner end of the platform part while being coupled to the rotor.

The gas turbine blade may further include a film cooling unit circumferentially formed on a portion of the platform part that cools a surface of the platform part.

It is to be understood that both the foregoing general description and the following detailed description of the present invention are exemplary and explanatory and are intended to provide further explanation of the invention as claimed.

BRIEF DESCRIPTION OF THE DRAWINGS

Embodiments of the present invention may be more clearly understood from the following detailed description taken in conjunction with the accompanying drawings, in which.

DETAILED DESCRIPTION

Figure 1:
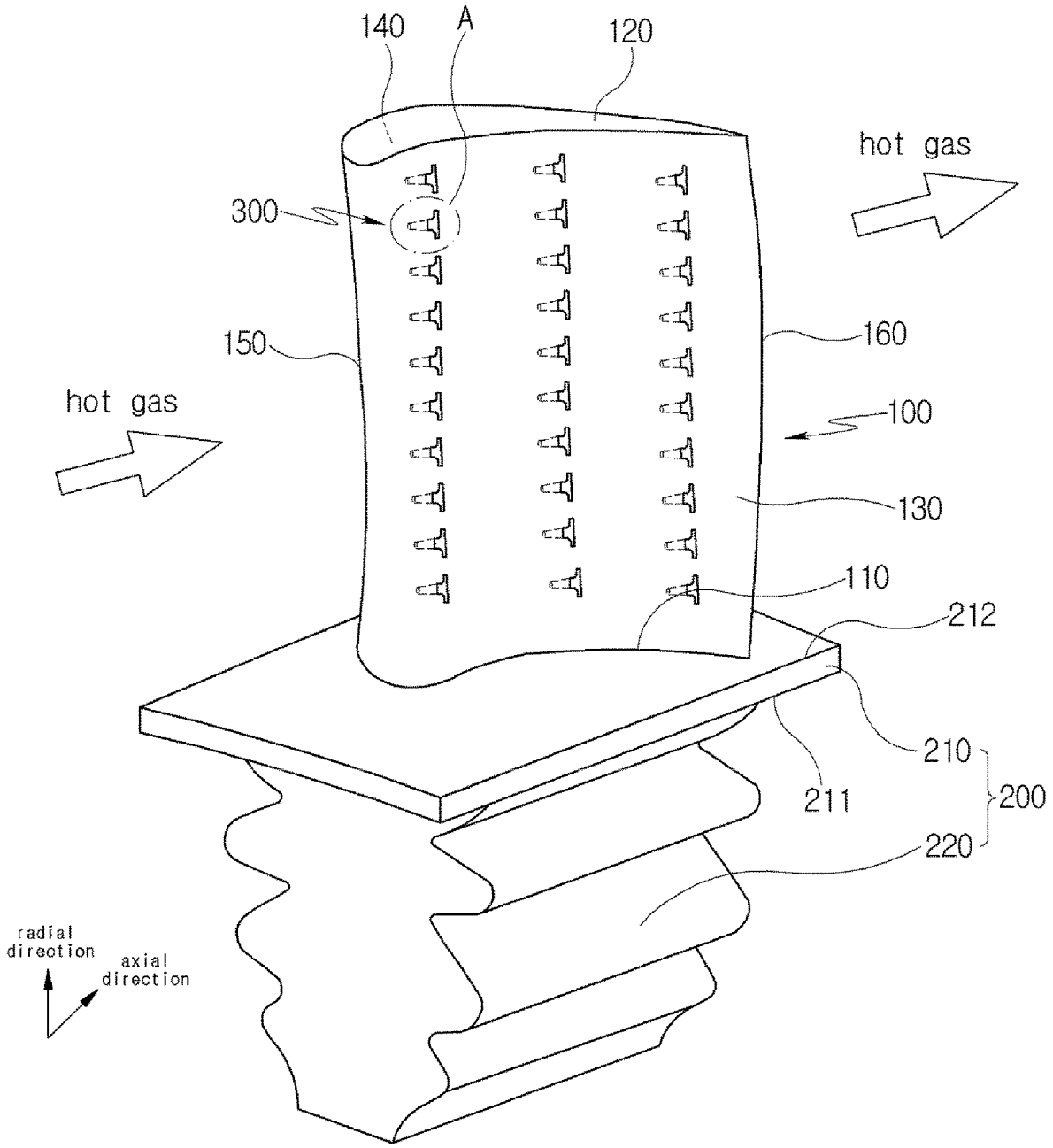
FIG. 1 is a perspective view illustrating a gas turbine blade according to an embodiment of the present invention.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Figure 2:
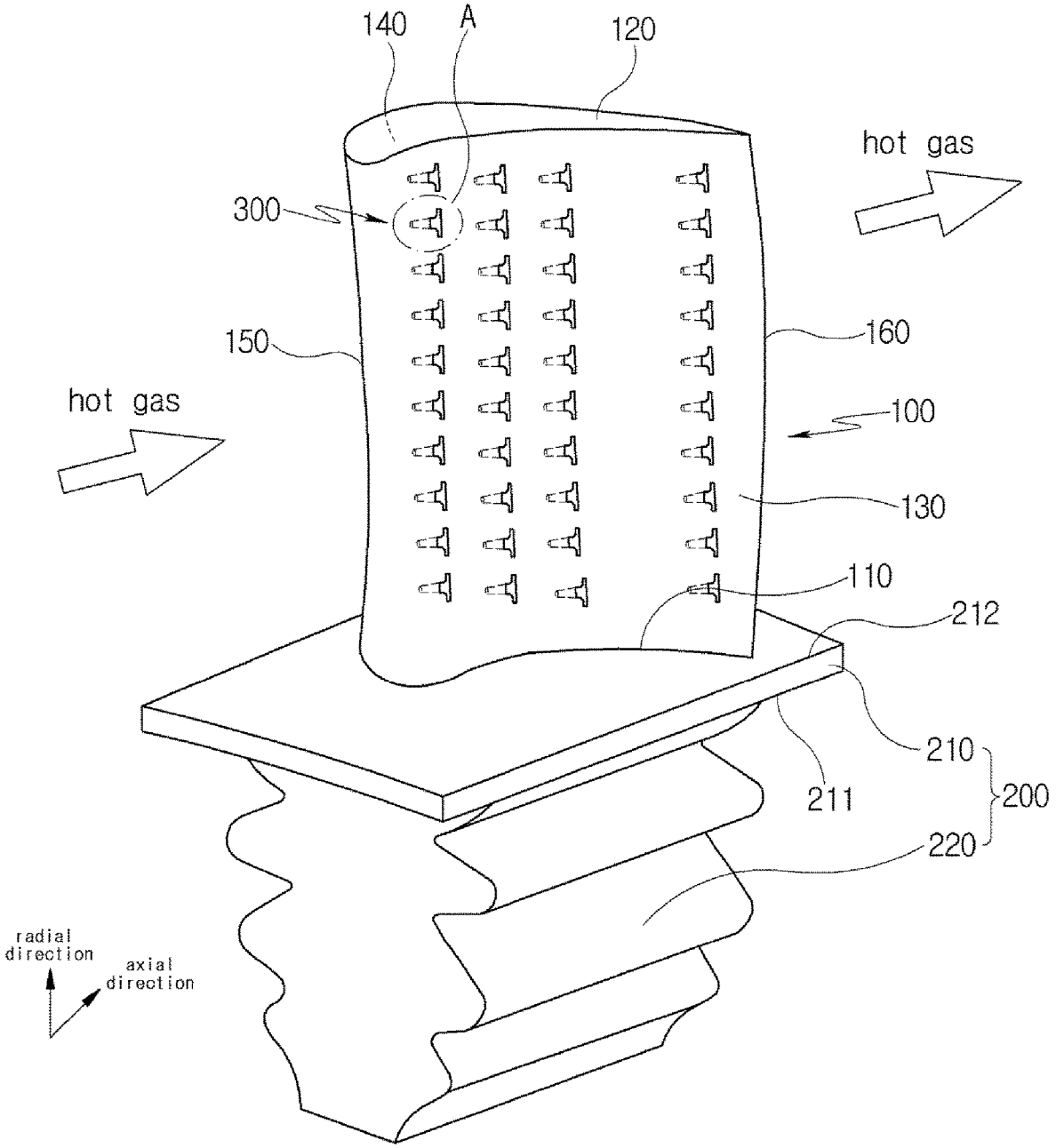
FIG. 2 is a perspective view illustrating another arrangement of a film cooling unit formed in the gas turbine blade according to an embodiment of the present invention.
Figure 3:
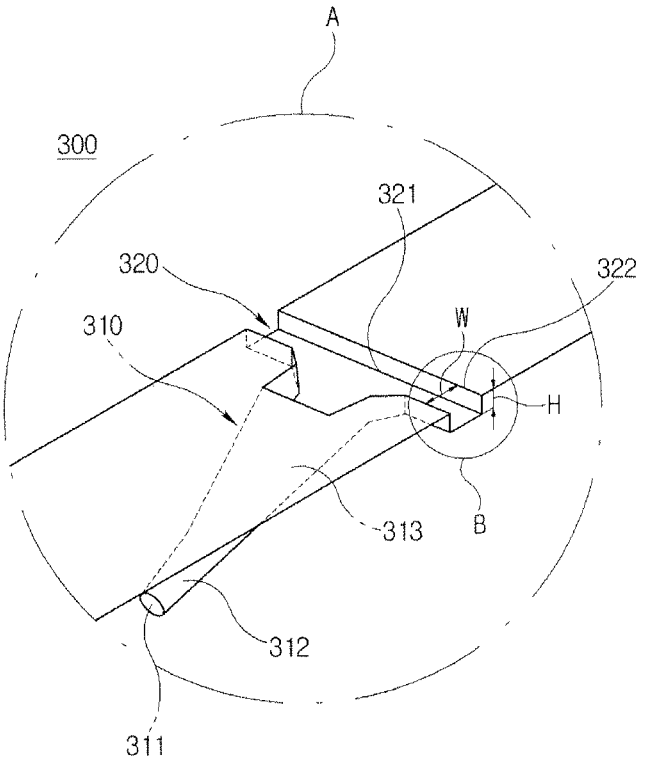
FIG. 3 is an enlarged view illustrating portion "A" of FIG. 1.
Figure 4:
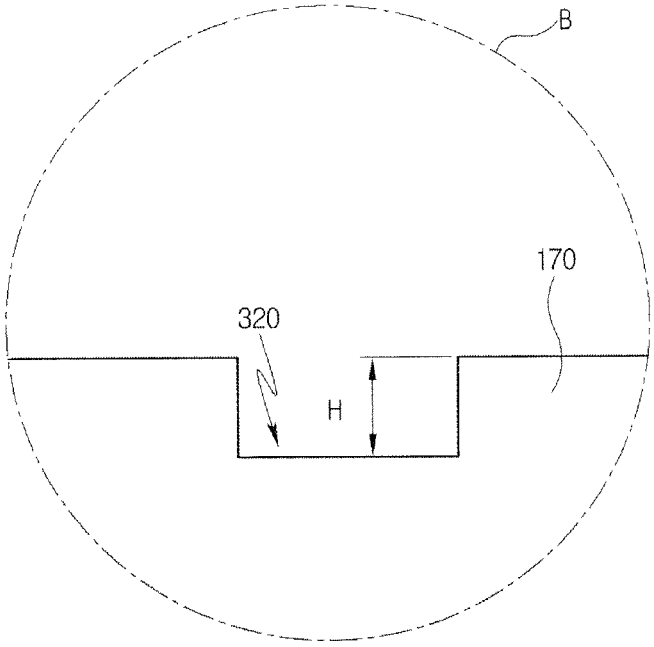
FIG. 4 is a side cross-sectional view illustrating portion "A" of FIG. 1.
Figure 5:
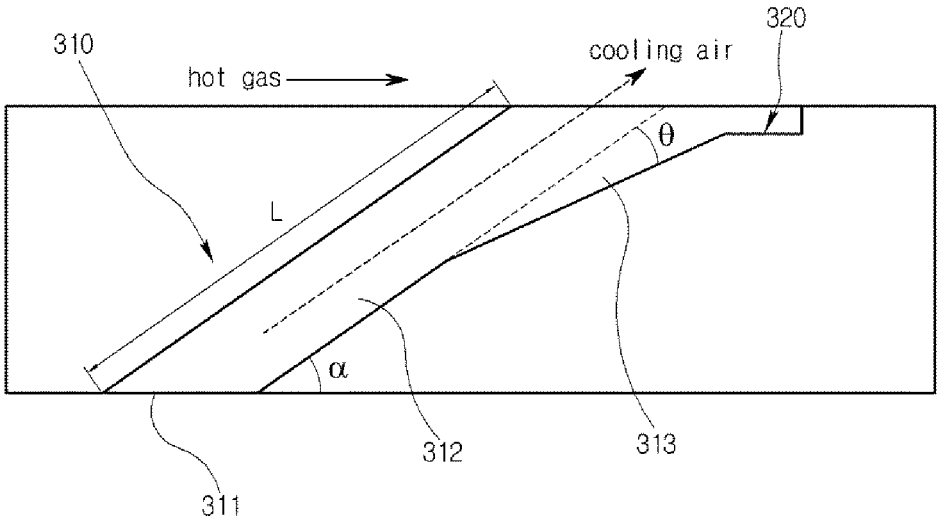
FIG. 5 is an enlarged view illustrating portion "B" of FIG. 3.
Figure 6:
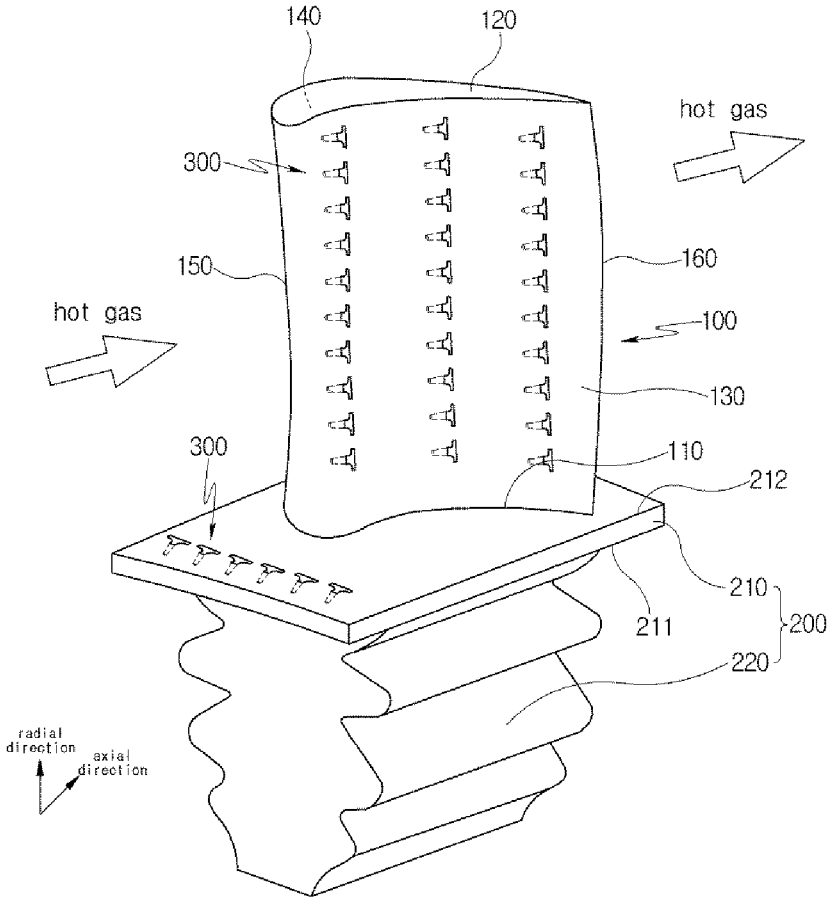
FIG. 6 is a perspective view illustrating a gas turbine blade according to another embodiment of the present invention.

FIG. 1 is a perspective view illustrating a gas turbine blade according to an embodiment of the present invention. FIG. 2 is a perspective view illustrating another arrangement of a film cooling unit formed in the gas turbine blade according to the embodiment of the present invention. FIG. 3 is an enlarged view illustrating portion "A" of FIG. 1. FIG. 4 is a side cross-sectional view illustrating portion "A" of FIG. 1. FIG. 5 is an enlarged view illustrating portion "B" of FIG. 3. FIG. 6 is a perspective view illustrating a gas turbine blade according to another embodiment of the present invention.

The terms used herein are defined as follows. The "axially (axial direction)" refers to a longitudinal direction of a rotary shaft such as a rotor of a gas turbine, and the "radially (radial direction)" refers to a direction oriented from the center of the rotary shaft to the outer peripheral surface thereof, or a direction opposite to the same. In addition, the "circumferentially (circumferential direction)" refers to a direction around the rotary shaft.

Gas turbine blades are circumferentially installed to a rotor or a rotor wheel, which is rotatably installed in a casing, so as to be spaced apart from each other by a predetermined distance.

The rotor is rotatably installed in the casing. The casing (not shown) is divided into an upper casing and a lower casing, and the upper and lower casings are assembled and coupled to each other. The casing accommodates the rotor and a bucket assembly therein, and serves to block or protect inter components from external impact or foreign substances. The rotor serves as a rotary shaft, and both ends of the rotor may be rotatably supported by bearings.

In addition, the gas turbine blades are installed to the rotor or the rotor wheel in a multistage manner so as to be spaced apart from each other by a predetermined distance in the direction of the rotary shaft.

Accommodation parts for accommodating dovetail parts 220 of root parts 200 to be described later are evenly spaced along the outer peripheral surface of the rotor in the tangential direction of the rotor. That is, each accommodation part is formed at the radial outer end of the rotor so as to have a certain depth in the axial direction of the rotor.

Although not illustrated in the drawings, the gas turbine blades according to the embodiment of the present invention may also be installed to a wheel & diaphragm type gas turbine.

The rotor wheel may have a disc or flange shape so as to protrude radially outward from the outer peripheral surface of the rotor.

The rotor wheel may have a circular or disc shape. The rotor wheel has a hollow hole formed at the center portion thereof. Since the rotor is coupled to the rotor wheel through the hollow hole, the rotor and rotor wheel may rotate integrally.

In the wheel & diaphragm type gas turbine, accommodation parts are evenly spaced along the outer peripheral surface of the rotor wheel in the tangential direction of the rotor wheel. That is, each accommodation part is formed at the radial outer end of the rotor wheel so as to have a certain depth in the axial direction of the rotor wheel.

The inner surface of the accommodation part has a shape corresponding to the outer surface of the dovetail part 220 of each root part 200 to be described later. Accordingly, the accommodation part is fastened to the dovetail part 220 of the root part 200 so as to engage therewith.

For example, the inner surface of the accommodation part is formed such that curved engagement portions having a fir tree shape are symmetric on the basis of the imaginary radial center line of the rotor. Similarly, the outer surface of the dovetail part 220 of the root part 200 is formed such that curved engagement portions having a fir tree shape are symmetric on the basis of the imaginary radial center line of the rotor.

That is, when the blade is axially inserted into the accommodation part such that the curved engagement portions formed on the outer surface of the dovetail part 220 of the root part 200 correspond to the curved engagement portions formed on the inner surface of the accommodation part, the blade is axially fastened to the accommodation part in the circumferential direction of the rotor. Accordingly, the blade is restricted in the radial and tangential directions of the rotor.

Various types of gas turbine blades, such as a tangential entry type, an axial entry type, and a pinned finger type, may be adopted as the gas turbine blade of the present invention.

The gas turbine blades according to an embodiment of the present invention will be described with reference to FIGS. 1 to 5. As illustrated in FIG. 1, one gas turbine blade according to the embodiment of the present invention includes a blade part 100, a root part 200, and a film cooling unit 300.

As described above, the plurality of blades is mounted to the rotor or the rotor wheel along the outer peripheral surface thereof.

The blade part 100 is supplied with steam generated by a boiler, and converts fluid energy thereof, i.e. heat energy and speed energy, into torque which is mechanical energy.

The blade part 100 includes a coating layer 170 for protecting the surface thereof from hot gas.

The coating layer 170 comprises a bonding layer formed on the surface of the blade part made of a metal material, and a ceramic layer formed on the bonding layer.

Although not illustrated in the drawings, the blade part 100 has a passage formed therein for supplying cooling air.

The blade part 100 has a crescent or airfoil cross-sectional shape, but the present invention is not limited thereto. Since the speed energy of fluid is increased by lift generated when hot gas passes along the blade part 100, torque may be increased.

The blade part 100 of the gas turbine blade according to the embodiment of the present invention includes a first surface 130, a second surface 140, a leading edge 150, and a trailing edge 160. In FIGS. 1 to 5, reference numeral 110 refers to the radial inner end of the blade part 100, and reference numeral 120 refers to the radial outer end of the blade part 100.

The outer surface of the first surface 130, in which fluid such as steam or hot gas flows in the axial direction of the rotor, has a curved concave or convex shape.

The outer surface of the second surface 140, in which fluid flows in the axial direction of the rotor, has a shape opposite to that of the first surface 130.

That is, when the outer surface of the first surface 130, in which hot gas flows in the axial direction of the rotor, is formed to be concave, the outer surface of the second surface 140, in which fluid flows in the axial direction of the rotor, is formed to be convex.

In contrast, when the outer surface of the first surface 130, in which hot gas flows in the axial direction of the rotor, is formed to be convex, the outer surface of the second surface 140, in which fluid flows in the axial direction of the rotor, is formed to be concave.

FIGS. 1 and 6 illustrate that the outer surface of the first surface 130, in which hot gas flows in the axial direction of the rotor, is formed to be concave, whereas the outer surface of the second surface 140, in which fluid flows in the axial direction of the rotor, is formed to be convex.

The leading edge 150 of the blade part 100 faces the introduction side of fluid. That is, the leading edge 150 is formed at a front edge at which the first surface 130 comes into contact with the second surface 140.

The trailing edge 160 of the blade part 100 faces the discharge side of fluid. That is, the trailing edge 160 is formed at a rear edge at which the first surface 130 comes into contact with the second surface 140.

The root part 200 is formed at the radial inner end 110 of the blade part 100. The blade is coupled to the rotor by the root part 200.

The root part 200 may also include a coating layer for protecting the root part 200 from hot gas.

As illustrated in FIG. 1, the root part 200 of the gas turbine blade according to the embodiment of the present invention includes a platform part 210 and a dovetail part 220.

The platform part 210 is formed at the radial inner end 110 of the blade part 100 so as to have a plate structure.

The dovetail part 220 is formed at a radial inner end 211 of the platform part 210.

The dovetail part 220 is preferably designed to endure the centrifugal stress during rotation of the blade. As described above, the outer surface of the dovetail part 220 may have a fir tree shape.

The film cooling unit 300 is formed on the blade part 100 for cooling thereof.

As illustrated in FIGS. 1 and 2, the film cooling unit 300 can include a plurality of film cooling units formed so as to be located on the same vertical line in the direction toward the outer end 120 of the blade part 100 from the inner end 110 thereof, in order to cool the blade part 100 as a whole. The film cooling units 300 may be arranged so as to axially form a plurality of rows.

As illustrated in FIGS. 1 and 6, the film cooling unit 300 of the gas turbine blade according to an embodiment of the present invention is formed on the first surface 130.

The film cooling unit 300 may include a plurality of film cooling units, if necessary, which are formed on the first surface 130 so as to be spaced by a predetermined distance in the radial direction of the blade part 100. The film cooling units 300 may form a plurality of rows in the direction of the rotary shaft while being spaced by a predetermined distance.

As illustrated in FIG. 6, a film cooling unit 300 of a gas turbine blade according to another embodiment of the present invention may be additionally and circumferentially formed on a portion of a platform part 210 for cooling the surface thereof, as well as a blade part 100.

That is, the film cooling unit 300 may include a plurality of film cooling units which are formed on a radial outer end 212 of the platform part 210 so as to be spaced by a predetermined distance.

Consequently, the gas turbine blade may be inhibited from being damaged due to hot gas by cooling the blade part 100 and the platform part 210, and it is possible to increase the service life of the gas turbine blade and reduce maintenance costs therefore.

As illustrated in FIGS. 3 and 4, the film cooling unit 300 of the gas turbine blade according to the embodiment of the present invention includes a film cooling hole part 310 and a trench part 320.

The film cooling hole part 310 allows cooling air to be supplied to the surface of the blade part 100 for cooling the surface of the blade part 100.

The film cooling hole part 310 may be formed by coating a film on the surface of the blade part 100, but the present invention is not limited thereto.

The trench part 320 is formed at the tip of the film cooling hole part 310.

The trench part 320 may be formed by masking, but the present invention is not limited thereto.

In addition, the trench part 320 may be formed by machining such as grinding, if necessary.

That is, the trench part 320 is formed at the tip of the film cooling hole part 310, which is a side opposite to the direction from which the hot gas is introduced.

Since the trench part 320 of the film cooling unit 300 for cooling the blade part 100 is formed at the tip of the film cooling hole part 310, the cooling efficiency of the blade can be improved by sufficiently cooling the blade part 100 even during introduction of a large amount of cooling air. In addition, it is possible to inhibit damage to the blade from being exposed to hot gas since the trench part 320 is formed to have a minimum width (W).

The film cooling hole part 310 of the film cooling unit 300 of the gas turbine blade according to the embodiment of the present invention includes a cooling groove portion 311, a flow portion 312, and a tube expansion portion 313.

Cooling air for cooling the surface of the blade part 100 flows into the cooling groove portion 311. That is, the cooling groove portion 311 communicates with a cooling passage formed in the blade part 100.

The flow portion 312 communicates with the cooling groove portion 311 in order for cooling air to flow to the surface of the blade part 100.

The flow portion 312 has a substantially cylindrical shape, and has a predetermined diameter and length, and a predetermined inclination angle ($\alpha$), but the present invention is not limited thereto.

The cooling groove portion 311 and the flow portion 312 may have the same diameter, but the present invention is not limited thereto.

In addition, the diameters of the cooling groove portion 312 and the flow portion 312 are smaller than the width of the blade. Thus, the flow velocity of the cooling air introduced into the flow portion 312 through the cooling groove portion 311 is increased.

The tube expansion portion 313 has a cross-sectional area that is increased toward the surface of the blade part 100 from the tip of the flow portion 312.

In addition, the tube expansion portion 313 has a predetermined inclination angle ($\theta$).

As such, as the cross-sectional area of the tube expansion portion 313 is increased toward the surface of the blade part 100, cooling air is spread and completely covers the trench part 320, thereby forming an air film. Consequently, the cooling efficiency of the blade can be increased.

The tube expansion portion 313 extends so as to be inclined downward toward the trench part 320 from the extended end of the flow portion 312. In this case, cooling air is ejected in a direction indicated by the dotted arrow through the opened space of the flow portion 312, and is supplied obliquely downward toward the bottom of the trench part 320 via the tube expansion portion 313.

It is preferable that cooling is performed through heat conduction by moving cooling air in the state in which the cooling air is in maximum contact with the bottom of the trench part 320 without floating upward.

To this end, since the tube expansion portion 313 extends so as to be inclined toward the trench part 320 at a predetermined inclination angle ($\theta$), a large amount of cooling air may be moved in the state in which it is in maximum contact with the bottom of the trench part 320.

Cooling is performed while after cooling air is moved from the trench part 320 to the front center portion thereof, it is branched into the left and the right and is moved. Therefore, the path of cooling air is simple in the course of flow, and the cooling air is consistently maintained in the state in which it is in contact with the bottom of the trench part. Consequently, a cooling effect is more uniformly maintained in the whole section of the trench part 320.

Since the film cooling hole part 310 is opened toward the center portion of the trench part 320, the path in which cooling air is moved toward the center of the trench part 320 is always maintained. The movement direction of cooling air is significant to improve the cooling performance of the trench part 320. Accordingly, when the film cooling hole part 310 is opened toward the center portion of the trench part 320, it is possible to more improve cooling efficiency according to movement of cooling, compared to when the film cooling hole part 310 is opened toward the side of the trench part.

That is, cooling efficiency is more uniformly maintained without deterioration at a specific position when cooling air is branched into the left and the right from the center of the trench part 320, and a cooling effect is further improved since the cooling air is moved along the bottom of the trench part.

The opened surface of the tube expansion portion 313 has a polygonal shape. This enables an area for discharge of cooling air to be relatively increased compared to when the opened surface of the tube expansion portion 313 has a circular shape. In addition, the surface of the trench part 320 facing the opened surface of the tube expansion portion 313, and the upper surface of the trench part 320 are simultaneously opened, thereby also increasing fluidity according to diffusion.

The width (W) of the trench part 320 is smaller than the width of the tube expansion portion 313. In this case, an amount of cooling air supplied to the trench part 320 is relatively increased. In addition, cooling air remains in the trench part 320 for a predetermined time without rapidly flowing out of the trench part 320. Therefore, a cooling effect is also improved, and problems related to hot gas are minimized.

The distance between the film cooling units 300 arranged around the leading edge 150 is relatively shorter than the distance between the film cooling units 300 arranged around the trailing edge 160. Accordingly, when the gas turbine blade rotates, the path in which a large amount of hot gas is initially moved toward the trailing edge 160 via the leading edge 150 is maintained.

When hot gas comes into contact with the blade part 100, the path in which the hot gas is moved along the outer peripheral surface of the blade part 100 is maintained. Therefore, when the distance between the film cooling units 300 arranged around the leading edge 150 is shorter than the distance between the film cooling units 300 arranged around the trailing edge 160, cooling performance can be consistently maintained through rapid heat transfer.

As illustrated in FIG. 5, the trench part 320 of the film cooling unit 300 of the gas turbine blade according to an embodiment of the present invention has a height (H) equal to the thickness of the coating layer 170 of the blade part 100.

Accordingly, by forming the trench part 320 through masking or the like, the costs and time required to manufacture the gas turbine blade can be reduced.

As illustrated in FIG. 3, the trench part 320 of the film cooling unit 300 of the gas turbine blade according to an embodiment of the present invention has the same width (W) and height.

Accordingly, when the trench part is formed to have a minimum width, cooling air may completely cover the whole surface of the blade part so as to form a cooling air film, thereby increasing cooling efficiency.

As illustrated in FIG. 3, the trench part 320 of the film cooling unit 300 of the gas turbine blade according to an embodiment of the present invention has a width (W) that is narrowed toward both ends 322 of the trench part from the center portion 321 of the trench part 320 adjacent to the tube expansion portion 313.

As such, when the width (W) of the trench part 320 is narrowed toward both ends 322 thereof, cooling air discharged through the tube expansion portion 313 is moved to both ends 322 of the trench part 320 and covers the whole trench part 320 so as to form a cooling film, thus reducing the width of the trench part improves cooling efficiency.

In the trench part 320 according to embodiments of the present invention, the ratio of the height (H) of the trench part 320 to the width (W) of the trench part 320 is 1:1 to 2 (H:L=1:1 to 2).

When the ratio of the height (H) of the trench part 320 to the width (W) of the trench part 320 is less than 1:1 to 2, cooling air is not effectively introduced into the trench part 320 so that the blade may not be efficiently cooled. When the ratio of the height (H) of the trench part 320 to the width (W) of the trench part 320 exceeds 1:1 to 2, hot gas is introduced into the trench part 320 so that the cooling efficiency is rapidly reduced.

Accordingly, since film effectiveness is improved by 30% or more according to the gas turbine blade of the present invention, the temperature of hot gas discharged from the outlet of the combustor may be increased by a temperature of about 100° C. Therefore, the overall efficiency of the gas turbine can be increased, the maintenance costs of the gas turbine can be reduced, and the durability and reliability of the gas turbine can be improved.

Figure 7:
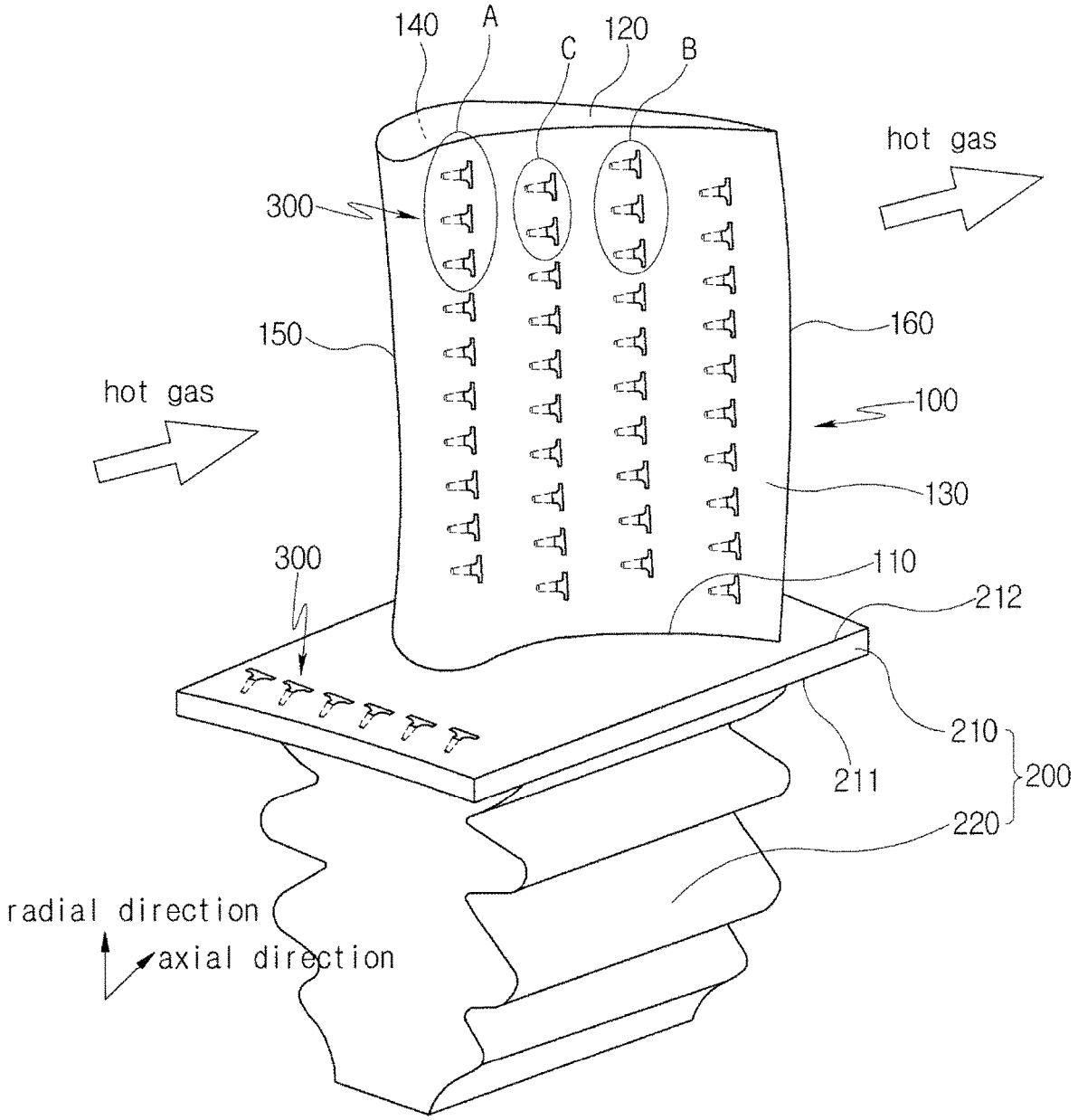
FIG. 7 is a perspective view illustrating arrangement of a film cooling unit formed in the gas turbine blade according to another embodiment of the present invention.

Referring to FIG. 7, the film cooling units 300 are alternately arranged on the first surface 130. In the case where the film cooling units 300 are arranged on the first surface 130 as illustrated in the drawing when hot gas moves from the leading edge 150 to the trailing edge 160, cooling by cooling air is performed in the overall region of the first surface 130 without being performed at a specific region thereof, and thus heat transfer is more uniformly performed.

That is, since the film cooling units 300 are not arranged on the same line, but are arranged alternately in portions "A" to "C", and portion "C" is located between portions "A" and "B", a dead zone in which cooling is not performed is minimized in portion "C".

Accordingly, by changing the arrangement of the film cooling units 300 arranged on the first surface 130, a cooling effect can be optimized and it is possible to improve the durability of the gas turbine blade and minimize the deformation of the gas turbine blade due to use for a long time.

As is apparent from the above description, in a gas turbine blade according to the present invention, a trench part of a film cooling unit for cooling a blade part is formed at the tip of a film cooling hole part. As a result, the cooling efficiency of the blade can be improved since the blade part is sufficiently cooled even during introduction of a large amount of cooling air, and it is possible to inhibit the blade from being damaged due to hot gas since the trench part is formed to have a minimum width.

In addition, since the temperature of hot gas discharged from the outlet of a combustor can be increased by an increase in cooling efficiency of the gas turbine blade according to the present invention, a gas turbine can have improved efficiency.

Furthermore, since the gas turbine blade according to the present invention is inhibited from being damaged, costs for maintenance and repair of the gas turbine can be reduced.

Moreover, the reliability and safety of the gas turbine can be improved by the gas turbine blade according to the present invention.

While the present invention has been described with respect to the specific embodiments, it will be apparent to those skilled in the art that various changes and modifications may be made without departing from the spirit and scope of the invention as defined in the following claims.

What is claimed is:

1. A gas turbine blade, comprising:

a blade part;

a root part formed at a radial inner end of the blade part and being coupled to a rotor; and a film cooling unit formed on the blade part that cools the blade part, wherein the film cooling unit comprises:

a film cooling hole part formed on a surface of the blade part that cools the surface of the blade part; and a trench part that is formed at a tip of the film cooling hole part and includes a flat upstream wall, a flat downstream wall, and a bottom surface connecting the upstream and downstream walls, the flat downstream wall facing the film cooling hole part and being formed of a continuous surface that is disposed perpendicularly with respect to a longitudinal direction of the film cooling hole part, wherein the film cooling hole part includes:

a flow portion formed to be a cooling passage for flowing cooling air, and a tube expansion portion communicating with a center portion of the flat upstream wall of the trench part and including a cross-sectional area formed to have a predetermined inclination angle, the tube expansion portion including a first side communicating with the surface of the blade part and a second side that is opposite to the first side and is inclined at the predetermined inclination angle, the cross-sectional area including (i) a first portion communicating with a center portion of the bottom surface of the trench part, and (ii) a second portion that communicates with the first portion and is formed at a predetermined position in the cooling passage of the flow portion, wherein the first portion has one side that is open to the surface of the blade part, and the second portion is not open to the surface of the blade part and is obstructed by the first side of the tube expansion portion, and wherein a diameter of the cooling passage formed on the second portion is determined based on the predetermined inclination angle and is bigger than a diameter of the flow portion.

2. The gas turbine blade according to claim 1, wherein:

the film cooling hole part comprises a cooling groove portion into which the cooling air for cooling the surface of the blade part is introduced;

the flow portion communicates with the cooling groove portion such that the cooling air flows to the surface of the blade part; and the cross-sectional area of the tube expansion portion increases toward the surface of the blade part from a tip of the flow portion.

3. The gas turbine blade according to claim 2, wherein the tube expansion portion extends so as to be inclined downward toward the trench part from an extended end of the flow portion.

4. The gas turbine blade according to claim 2, wherein the one side of the first portion of the tube expansion portion has a polygonal shape.

5. The gas turbine blade according to claim 1, wherein the trench part has a height equal to a thickness of a coating layer formed on the blade part.

6. The gas turbine blade according to claim 1, wherein the trench part has a same width and height.

7. The gas turbine blade according to claim 1, wherein a ratio of a height to a width of the trench part is 1:1 to 2.

8. The gas turbine blade according to claim 1, wherein the trench part has a smaller width than a width of the tube expansion portion.

9. The gas turbine blade according to claim 1, wherein when the cooling air is supplied to a region of the trench part, the cooling air is ejected toward a center of the trench part through the film cooling hole part, and is then branched into both left and right sides to move, and thereby perform cooling.

10. The gas turbine blade according to claim 1, wherein the blade part comprises:

a leading edge facing an introduction side of fluid;

a trailing edge facing a discharge side of fluid; and first and second surfaces connecting the leading edge to the trailing edge, wherein the film cooling unit is formed on the first surface.

11. The gas turbine blade according to claim 10, wherein the film cooling unit includes a plurality of film cooling units alternately arranged on the first surface.

12. The gas turbine blade according to claim 1, wherein the film cooling hole part formed in the film cooling unit is formed by coating a film.

13. The gas turbine blade according to claim 1, wherein the trench part is formed by masking.

14. The gas turbine blade according to claim 1, wherein the trench part includes a center portion that is formed by fillet processing.

15. The gas turbine blade according to claim 1, wherein the root part comprises:

a platform part formed at the radial inner end of the blade part; and a dovetail part formed at a radial inner end of the platform part and being coupled to the rotor.

16. The gas turbine blade according to claim 15, further comprising a film cooling unit circumferentially formed on a portion of the platform part that cools a surface of the platform part.

17. The gas turbine blade according to claim 1, wherein the trench part includes a center portion adjacent to the tube expansion portion and end portions that are disposed on either side of the center portion and respectively extend from the center portion to either end of the trench part, and wherein the trench part has a width that is narrowed toward both ends of the trench part from the center portion of the trench part adjacent to the tube expansion portion of the film cooling hole part, the width of the trench part at the center portion being a distance from the tube expansion portion of the film cooling hole part to the flat downstream wall of the trench part, and the width of the trench part at the end portions being a distance from the flat upstream wall of the trench part to the flat downstream wall of the trench part.

* * * * *